US009346600B2

(12) United States Patent
Furusawa et al.

(10) Patent No.: US 9,346,600 B2
(45) Date of Patent: May 24, 2016

(54) DISCHARGE CONTAINER

(71) Applicants: Mitsuo Furusawa, Osaka (JP); Shinya Hoshino, Tokyo (JP); Shigeo Iizuka, Tokyo (JP)

(72) Inventors: Mitsuo Furusawa, Osaka (JP); Shinya Hoshino, Tokyo (JP); Shigeo Iizuka, Tokyo (JP)

(73) Assignee: YOSHINO KOGYOSHO CO., LTD., Tokyo (JP)

( * ) Notice: Subject to any disclaimer, the term of this patent is extended or adjusted under 35 U.S.C. 154(b) by 0 days.

(21) Appl. No.: 14/353,957

(22) PCT Filed: Oct. 26, 2012

(86) PCT No.: PCT/JP2012/077739

§ 371 (c)(1),
(2) Date: Apr. 24, 2014

(87) PCT Pub. No.: WO2013/065599

PCT Pub. Date: May 10, 2013

(65) Prior Publication Data

US 2014/0263443 A1 Sep. 18, 2014

(30) Foreign Application Priority Data

Oct. 31, 2011 (JP) ..... 2011-238557
Nov. 29, 2011 (JP) ..... 2011-260052

(51) Int. Cl.
*B65D 77/06* (2006.01)
*B65D 83/00* (2006.01)
(Continued)

(52) U.S. Cl.
CPC ..... *B65D 77/06* (2013.01); *B65D 47/2031* (2013.01); *B65D 47/32* (2013.01); *B65D 51/1644* (2013.01); *B65D 83/0055* (2013.01)

(58) Field of Classification Search
CPC .... B65D 47/2031; B65D 47/32; B65D 77/06; B65D 51/1644; B65D 83/0055
See application file for complete search history.

(56) References Cited

U.S. PATENT DOCUMENTS 6,095,382 A * 8/2000 Gross ..... 222/520
2004/0060889 A1 4/2004 Yoneyama et al.
(Continued)

FOREIGN PATENT DOCUMENTS

CN 1481319 A 3/2004
CN 1671601 A 9/2005
(Continued)

OTHER PUBLICATIONS

Jan. 6, 2015 Chinese Office Action issued in Chinese Application No. 201280052811.5.
(Continued)

*Primary Examiner* — Nicholas J Weiss
(74) *Attorney, Agent, or Firm* — Oliff PLC

(57) ABSTRACT

A discharge container includes a container main body having an inner container and an outer container, and a discharge cap, a suction hole configured to suction external air to a space between the inner container and the outer container is formed in the outer container, the discharge cap includes an air valve configured to switch between allowing and blocking communication between the outside of the discharge cap and the suction hole, and a discharge film elastically deformable to close the discharge port, and a slit is formed in the discharge film. As the discharge film is elastically deformed according to an increase in the pressure inside the inner container, the slit is widened and opened to open the discharge port.

4 Claims, 8 Drawing Sheets

(51) Int. Cl.

| | |
|---|---|
| ***B65D 47/20*** | (2006.01) |
| ***B65D 51/16*** | (2006.01) |
| ***B65D 47/32*** | (2006.01) |

(56) References Cited

U.S. PATENT DOCUMENTS

| | | | | |
|---|---|---|---|---|
| 2006/0043116 | A1 | 3/2006 | Kawashiro et al. | |
| 2006/0054635 | A1 * | 3/2006 | Iwahashi et al. | 222/107 |

FOREIGN PATENT DOCUMENTS

| | | | | | |
|---|---|---|---|---|---|
| DE | 101 09 064 | A1 | | 9/2002 | |
| EP | 1 593 605 | A1 | | 11/2005 | |
| JP | A-2002-080055 | | | 3/2002 | |
| JP | A-2003-321074 | | | 11/2003 | |
| JP | A-2004-001780 | | | 1/2004 | |
| JP | A-2007-176526 | | | 7/2007 | |
| JP | 2008162666 | A | * | 7/2008 | B65D 83/00 |
| JP | 2009-149327 | A | | 7/2009 | |
| JP | A-2009-291326 | | | 12/2009 | |
| WO | 00/17092 | A1 | | 3/2000 | |

OTHER PUBLICATIONS

International Search Report issued in International Application No. PCT/JP2012/077739 dated Feb. 5, 2013 (with translation).

May 4, 2015 Search Report issued in European Patent Application No. 12846350.2.

* cited by examiner

DISCHARGE CONTAINER

TECHNICAL FIELD

The present invention relates to a discharge container. In particular, the present invention relates to a discharge container constituted by a container main body in which an inner container configured to form a volume-reducible inner package is stacked and formed to be separable in an outer container configured to form an outer shell, and a discharge cap assembled to a port section of the container main body.

Priority is claimed on Japanese Patent Application Nos. 2011-238557, filed Oct. 31, 2011, and 2011-260052, filed Nov. 29, 2011, the contents of which are incorporated herein by reference.

BACKGROUND ART

In the related art, for example, as disclosed in Patent Document 1, a discharge container including a container main body having an inner container in which contents are accommodated and abundant flexibility to be deformed according to reduction in an accommodation amount of the contents and an outer container in which the inner container is installed and configured to be elastically deformed, and a discharge cap mounted on a port section of the container main body and having a discharge port configured to discharge the contents is known. In the discharge container, a suction hole through which external air is suctioned is formed at a position at substantially a center of upper, lower, left and right sides of a trunk section of the outer container and disposed between the outer container and the inner container. In addition, the discharge cap includes a communication hole configured to bring the discharge port in communication with the inside of the inner container, and a valve member configured to switch between allowing and blocking communication between the discharge port and the communication hole.

In the discharge container, when the contents accommodated in the inner container of the container main body are discharged, the outer container of the container main body is squeezed and deformed (elastically deformed). Accordingly, the inner container is deformed with the outer container to be reduced in volume. Then, the pressure of the inner container increases due to the volume-reducing deformation. The valve member is opened by the increased pressure, and the discharge port comes in communication with the inside of the inner container via the communication hole. Accordingly, the contents accommodated in the inner container are discharged from the discharge port.

In addition, a synthetic resin bottle capable of volume-reducing deformation and recovering deformation is known as a discharge container in which viscous contents such as shampoo, sauce, or the like, are dischargeably accommodated. As such a synthetic resin bottle, a so-called delamination bottle-type discharge container in which the inner container is separated from the outer container and the volume thereof is reduced is known. The delamination bottle-type discharge container has a discharge valve configured to form the discharge port of the contents, and a suction valve configured to introduce external air into a space between the outer container and the inner container.

The discharge valve forms the discharge port of the contents. In general, it is not easy to completely empty viscous contents. For this reason, like the related art disclosed in Patent Document 2, a configuration in which a slit valve formed of a soft elastic material is used as a discharge valve and good "liquid exhaustion" can be obtained is considered.

In the configuration in which the slit valve is used as the discharge valve, even when the contents are viscous, an action by which they are completely emptied can be accomplished.

DOCUMENT OF RELATED ART

Patent Documents

[Patent Document 1] Japanese Unexamined Patent Application, First Publication No. 2009-291326

[Patent Document 2] Japanese Unexamined Patent Application, First Publication No. 2004-001780

SUMMARY OF INVENTION

Technical Problem

In the discharge container disclosed in Patent Document 1, the contents remaining between the discharge port and the valve member after discharge may be unintentionally leaked from the discharge port, for example, upon the next discharge manipulation or the like.

In addition, in the related art disclosed in Patent Document 2, a secure check valve function should be given to the discharge valve of the slit valve structure. For this reason, the thickness of a valve acting portion of the discharge valve needs to be increased or the shape of the discharge valve needs to be formed in the shape of an artillery shell, and thus, it is pointed out that the material cost is increased, the degree of design freedom is decreased, or the like. For this reason, it is desirable that the unit consumption of an expensive soft elastic material is reduced, that the limitations on the shape of the discharge valve be removed, and the degree of design freedom be increased.

In consideration of the above-mentioned circumstances, the present invention is directed to provide a discharge container capable of securing the quality of contents, and of preventing leakage from a discharge port without increasing the number of parts.

In addition, the present invention is directed to provide a discharge container capable of maintaining a discharge valve of a slit valve structure at a thickness and a shape of a conventional slit valve, exhibiting a high check valve function, and obtaining a small amount of unit consumption of an expensive soft elastic material and a large degree of design freedom.

Means for Solving the Problems

A discharge container according to a first aspect of the present invention includes a container main body having an inner container configured to accommodate contents and deformed according to a reduction in the amount of contents, and an outer container in which the inner container is installed to be elastically deformed; and a discharge cap mounted on a port section of the container main body, and having a discharge port configured to discharge the contents and a communication hole configured to bring the discharge port in communication with the inside of the inner container. Then, a suction hole configured to suction external air into a space between the inner container and the outer container is formed in the outer container. Further, the discharge cap includes: an air valve configured to switch between allowing and blocking communication between the outside of the discharge cap and the suction hole; and a discharge film elastically deformable to close the discharge port. In addition, a slit is formed in the discharge film, and the slit is widened and opened to open the discharge port as the discharge film is elastically deformed according to an increase in the pressure inside the inner container.

According to a second aspect of the present invention, in the discharge container according to the first aspect, the discharge cap includes: an external air introduction hole configured to bring the outside in communication with the suction hole; and a valve member configured to switch between allowing and blocking communication between the discharge port and the communication hole. Further, the air valve switches between allowing and blocking communication between the suction hole and the external air introduction hole, and the inside of the communication hole communicates with the inside of the inner container and is formed at a top section of a topped tubular body protruding from the port section of the container main body toward the outside of the container main body in a container axial direction.

In the discharge container according to the aspect, when the contents accommodated in the inner container of the container main body are discharged, the outer container of the container main body is squeezed and deformed (elastically deformed). Accordingly, the inner container is deformed with the outer container to be reduced in volume. Then, the pressure inside the inner container becomes a positive pressure according to the volume-reducing deformation. Then, the valve member is opened by the increased pressure, and the discharge port communicates with the inside of the inner container through the communication hole. In addition, here, when the container main body is inclined, the weight of the contents is applied to the valve member.

Then, as the valve member is opened in this way, when the pressure (the positive pressure) inside the inner container, along with the container main body, is inclined, the weight of the contents is applied to the discharge film, the discharge film is elastically deformed to widen and open the slit, and the discharge port is opened. As a result, the contents accommodated in the inner container are discharged from the discharge port.

After that, when the pressure inside the inner container is reduced, the valve member is closed, and the communication between the discharge port and the inside of the inner container through the communication hole is blocked. Then, the discharge film is deformed so as to be recoverable by the elastic recovering force, the slit is closed, and the discharge port is closed. As the valve member is closed as described above, when the inner container is sealed and the above-mentioned squeeze deformation is released, a force of deforming to recover the outer container is applied. Here, as the negative pressure generated between the outer container and the inner container is applied to the air valve through the suction hole, the air valve is operated, the suction hole comes in communication with the outside through the external air introduction hole, and the external air is suctioned into the space between the outer container and the inner container.

Then, as the external air is suctioned, when the pressure between the outer container and the inner container is increased to atmospheric pressure, the air valve is deformed so as to be recoverable to block the suction hole and the external air introduction hole. In this way, as the external air is suctioned into the space between the outer container and the inner container, a volume-reduced shape of the inner container is held.

From this state, when the outer container of the container main body is squeezed and deformed again, since the air valve is in the blocked state, the pressure between the outer container and the inner container becomes a positive pressure, and the inner container is deformed to reduce the volume thereof by the increased pressure. As the inner container is deformed as the volume is reduced, the same effect as described above is obtained, and the contents are discharged.

Then, in the discharge container according to the aspect, since the valve member is closed and the inner container is in the sealed state except when the contents are discharged, the quality of the contents is secured. Further, in the discharge container according to the aspect, the discharge port is not opened until the discharge film is elastically deformed to widen and open the slit. For this reason, the sealability of the discharge container is increased. Accordingly, after the discharge, even when the contents remain between the discharge port and the valve member, unintentional leakage of the contents from the discharge port is prevented.

In addition, since the discharge container according to the aspect has the configuration in which the discharge film is deformed so as to recoverable to close the slit, a liquid exhaustion property of the discharge port is increased and leftover liquid of the contents is prevented.

Further, since the discharge container according to the aspect has the simple configuration in which the discharge port is opened and closed by elastic deformation and recovering deformation of the discharge film, the number of parts can be reduced and the above-mentioned remarkable effect can be exhibited. Further, in the discharge container according to the aspect, the communication hole comes in communication with the inside of the inner container, and is formed in the top section of the topped tubular body protruding from the port section of the container main body toward the outside of the container main body in the container axial direction. For this reason, the distance between the communication hole and the discharge port is reduced, and the space generated therebetween can be reduced. Then, in this way, when the space between the communication hole and the discharge port is reduced, the amount of contents remaining in the space can be suppressed. As a result, unintentional leakage of the contents from the discharge port is more securely prevented.

According to a third aspect of the present invention, in the discharge container according to the second aspect of the present invention, the discharge film is formed in a curved surface shape protruding toward the outside of the container main body in the container axial direction, and the slit is formed in a central section of the discharge film.

In the case of the discharge container according to the third aspect of the present invention, since the slit is widened and opened even when the discharge film is not largely deformed by the pressure of the inner container, the contents can be smoothly discharged.

According to the fourth aspect of the present invention, in the discharge container according to the first aspect, a suppressing section configured to apply a suppressing force to the flow of the contents is disposed near the inside of the discharge film.

In the discharge container according to the aspect, when the pressing force with respect to the container main body is removed, since the outer container is returned to its original shape by the recovering force, reduction of the pressure inside the container main body is generated. The air valve is rapidly opened by the pressure reduction, the external air is suctioned into the space between the outer container and the inner container, and the reduced pressure disappears. Here, the pressure reduction is also applied to the discharge film. However, since the contents are accommodated inside the discharge film in a state in which the flow of the contents is suppressed by the suppressing section, i.e., a state in which the contents cannot be easily moved, the discharge film cannot be rapidly opened. As a result, in a state in which the pressure is reduced, the check valve function can be securely exhibited. In addition, even when the flow of the contents is not suppressed by the suppressing section, as the discharge film abuts the suppressing section disposed adjacent thereto, since opening and deformation of the discharge film toward the inner container are interfered, the check valve function can be more securely exhibited in a state in which the pressure is reduced.

In addition, when the container main body is pressed to discharge the contents, the suppressing section applies the suppressing action to the discharged contents. The suppressing action applies an influence such that the pressing force applied to the container main body should be slightly increased in order to open the discharge film and discharge the contents. That is, in actual use, there is no inconvenience due to the influence.

In this way, the secure check valve function exhibited by the discharge film can be obtained by combination with the suppressing section, i.e., a flow suppressing action of the suppressing section with respect to the contents disposed inside the discharge film. That is, the discharge film can be formed as a conventional thin slit valve structure capable of rapidly obtaining the opening/closing valve function. In addition, the shape of the discharge valve can also be freely set to a desired shape without being limited to an artillery shell.

According to a fifth aspect of the present invention, in the discharge container according to the fourth aspect, the discharge cap includes a cap main body having an outer tube body configured to cover the discharge cap on the port section of the container main body; an inner support plug hermetically assembled to an opening end of the port section and formed in a tubular shape having a top section; and a valve body hermetically assembled and fixed to be sandwiched between the inner support plug and the cap main body, wherein a top plate portion of the inner support plug disposed near the inside of the discharge film installed at the valve body is configured such that a baffle plate piece having a beam plate piece shape remains to open the communication hole, and the baffle plate piece is the suppressing section.

As the suppressing section is installed at the inner support plug configured to sandwich the discharge tube body between the cap main body and the suppressing section and the baffle plate piece is constituted by the suppressing section, the suppressing section can be stably and securely disposed near the inside of the discharge film.

According to a sixth aspect of the present invention, in the discharge container according to the fifth aspect, the slit formed in the discharge film is formed in a cross shape, and the baffle plate piece has a cross beam piece shape disposed opposite to the slit.

According to the configuration, the baffle plate piece can be securely disposed near the slit, which is an opening/closing hole section of the discharge film. For this reason, the baffle plate piece directly applies the suppressing action to the flow of the contents disposed inside the slit. Accordingly, the suppressing action of the suppressing section with respect to the contents can be extremely effectively exhibited.

EFFECTS OF THE INVENTION

According to the discharge container, quality of the contents can be secured, and leakage from the discharge port can be prevented without increasing the number of parts.

In addition, the discharge container can obtain a secure check valve function by a flow suppressing action of a suppressing section with respect to the contents disposed inside the discharge film. For this reason, the discharge film can form a conventional thin slit valve structure. In addition, a shape of the discharge film can also be freely set to a desired shape. As a result, as a use amount of the expensive soft elastic material that forms the discharge film is reduced, the material cost can be reduced, and the degree of freedom in setting the structure of the discharge film can be increased.

In addition, the suppressing section can be stably and securely disposed at a position near the inside of the discharge film. For this reason, the suppressing action with respect to the suppressing section can be effectively and efficiently applied to the check valve function of the discharge film.

Further, the baffle plate piece can be securely disposed at a position near the slit, which is the opening/closing hole section of the discharge film. For this reason, the suppressing action of the suppressing section with respect to the contents can be extremely effectively exhibited. Accordingly, the discharge film can exhibit a stable and secure check valve function.

DESCRIPTION OF EMBODIMENTS

[First Embodiment]

Hereinafter, a discharge container according to a first embodiment of the present invention will be described with reference to the accompanying drawings.

Figure 1:
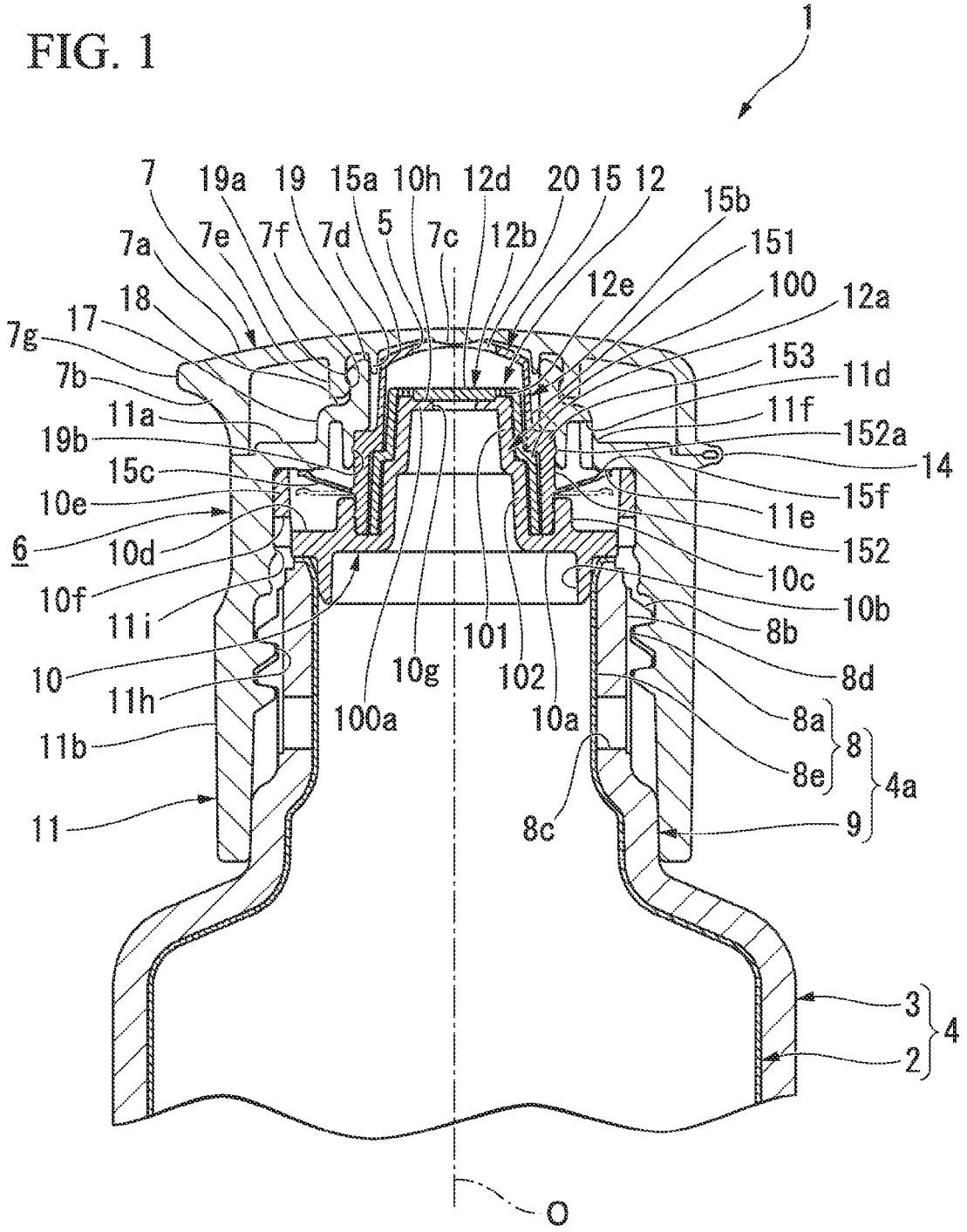
FIG. 1 is a side cross-sectional view showing a major portion of a discharge container according to a first embodiment of the present invention.

As shown in FIG. 1, a discharge container 1 includes a container main body 4, a discharge cap 6, and an over cap 7. The container main body 4 includes an inner container 2 configured to accommodate contents and having flexibility to be deformed according to reduction of the contents, and an outer container 3 in which the inner container 2 is installed to be elastically deformed. The discharge cap 6 has a discharge port 5 mounted on a port section 4*a* of the container main body 4 and configured to discharge the contents. The over cap 7 is detachably mounted on the discharge cap 6.

The container main body 4 is formed in a tubular shape having a bottom section, and the over cap 7 is formed in a tubular shape having a top section. Central axes of the container main body 4 and the over cap 7 are disposed on a common axis. Hereinafter, the common axis is referred to as a container axis O, the over cap 7 side in the container axis O direction is referred to as an upper side, and a bottom section side of the container main body 4 is referred to as a lower side.

In addition, a direction perpendicular to the container axis O is referred to as a radial direction, and a direction orbiting about the container axis O is referred to as a circumferential direction.

The container main body 4 is constituted by a so-called delamination bottle in which the inner container 2 is stacked to be separable from the inner surface of the outer container 3. The port section 4*a* of the container main body 4 is formed in a two-step tubular shape including an upper tube section 8 disposed at an upper side, and a lower tube section 9 disposed at a lower side and having a larger diameter than the upper tube section 8.

In the upper tube section 8, a male screw section 8*b* is formed at an outer circumferential surface of a portion (hereinafter referred to as an outer upper tube section) 8*a* constituted by the outer container 3. In the outer upper tube section 8*a*, a suction hole 8*c* configured to suction the external air into a space between the inner container 2 and the outer upper tube section 8*a* is formed at a portion disposed under the male screw section 8*b*. In the outer circumferential surface of the outer upper tube section 8*a*, grooves 8*d* extending in the container axis O direction are formed at a portion corresponding to the suction hole 8*c* and a portion disposed at an upper side thereof. The male screw section 8*b* is divided by the grooves 8*d* in the circumferential direction.

A portion (hereinafter referred to as an inner upper tube section) 8*e* of the upper tube section 8 constituted by the inner container 2 is stacked on the inner circumferential surface of the outer upper tube section 8*a*. The upper end section of the inner upper tube section 8*e* is disposed on an opening edge of an upper end of the outer upper tube section 8*a* bent outward in the radial direction. The container main body 4 is formed by, for example, blow-forming a parison having a two-layered structure formed through co-extrusion. As an example, the outer container 3 is formed of a polyethylene resin, and the inner container 2 is formed of a polyamide-based synthetic resin with no mutual solubility with respect to the polyethylene resin.

The discharge cap 6 includes an inner tube body 10, an outer tube body 11, a valve tube body 12, and a discharge tube body 15. The inner tube body 10 includes a ceiling wall section 10*a* and a circumferential wall section 10*b*, and is formed in a tubular shape having a top section. A locking tube 10*c* having a smaller diameter than the circumferential wall section 10*b* stands on the ceiling wall section 10*a*, and a topped tubular body 100 having a smaller diameter than the locking tube 10*c* also stands on the ceiling wall section 10*a*. Here, the circumferential wall section 10*b*, the locking tube 10*c* and the topped tubular body 100 are disposed concentrically with the container axis O.

The inside of the topped tubular body 100 is in communication with the inside of the inner container 2, and the topped tubular body 100 protrudes upward from the port section 4*a* of the container main body 4 and is formed to be longer than the locking tube 10*c* in the container axis O direction. A gap in the radial direction is formed between the topped tubular body 100 and the locking tube 10*c*. In addition, the topped tubular body 100 is formed in a two-step tubular shape including an upper tube section 101 disposed at the upper side, and a lower tube section 102 disposed at the lower side and having a larger diameter than the upper tube section 101.

The circumferential wall section 10*b* of the inner tube body 10 is fitted into the port section 4*a* of the container main body 4. An annular brim section 10*d* extending in the circumferential direction while protruding outward in the radial direction is formed at an upper end section of the circumferential wall section 10*b*. The brim section 10*d* is disposed on an opening edge of an upper end of the port section 4*a*. Here, a fitting tube section 10*e* protrudes upward from an outer edge section of the brim section 10*d*. In addition, a plurality of external air circulation holes 10*f* passing in the radial direction and opened downward are formed at a lower end section of the fitting tube section 10*e* in the circumferential direction at intervals.

A communication hole 10*g* passing in the container axis O direction is formed at a center in a radial direction of a top section 100*a* of the topped tubular body 100. The communication hole 10*g* is in communication with the discharge port 5 of the discharge tube body 15 and the inside of the inner container 2. A circumferential edge section of the communication hole 10*g* in the top section 100*a* constitutes a valve seat 10*h* of a valve body 12*d* (to be described below). Here, a lower end section of the topped tubular body 100 is disposed at a position over the upper end edge or flush with the upper end edge of the port section 4*a* of the container main body 4, and the top section 100*a* of the topped tubular body 100 is spaced upward a certain distance from the port section 4*a*.

The outer tube body 11 includes a ceiling wall section 1 la and a circumferential wall section 11*b*, is formed in a tubular shape having a top section, and is disposed concentrically with the container axis O. An opening disposed about the container axis O is formed in the ceiling wall section 11*a*. Then, the outer tube body 11 includes a connecting tube 17, a flange 18, and a discharge tube suppressing member 19. The connecting tube 17 stands on a circumferential edge section of the opening of the ceiling wall section 11*a*. The flange 18 is formed in an annular shape, and extends in the circumferential direction while protruding inward from an upper end open port section of the connecting tube 17 in the radial direction. The discharge tube suppressing member 19 is formed in a tubular shape having a smaller diameter than the connecting tube 17, and a central section in the container axis O direction of the outer circumferential surface is connected to an opening circumferential edge section inside in the radial direction of the flange 18.

An upper end section of the fitting tube section 10*e* abuts a lower surface of the ceiling wall section 11*a*. In addition, in the lower surface of the ceiling wall section 11*a*, an annular air valve seat 11*e* extending in the circumferential direction is formed at a position further inside in the radial direction than an abutting portion with the fitting tube section 10*e*. Here, the top section 100*a* of the topped tubular body 100 is disposed over an upper surface of the ceiling wall section 11*a*.

In addition, an outer circumferential surface of the fitting tube section 10*e* abuts an inner circumferential surface of an upper end section of the circumferential wall section 11*b*. Further, an annular protrusion 11*i* abutting the lower end section of the fitting tube section 10*e* is formed at the inner circumferential surface of the circumferential wall section 11*b*. The annular protrusion 11*i* extends in the circumferential direction while protruding inward in the radial direction.

In the inner circumferential surface of the circumferential wall section 11*b*, a female screw section 11*h* threadedly engaged with the male screw section 8*b* of the port section 4*a* of the container main body 4 is formed at a portion disposed at a lower side of the annular protrusion 11*i*. In addition, the lower tube section 9 of the port section 4*a* is hermetically fitted into the lower end section of the circumferential wall section 11*b*. Accordingly, the suction hole 8*c* is prevented from being in communication with the outside of the discharge container 1 from a lower side of the circumferential wall section 11*b* of the outer tube body 11.

An external air introduction hole 11*d* formed to pass in the radial direction is formed in a portion in the circumferential direction of the lower end section of the connecting tube 17. The external air introduction hole 11*d* is configured to bring the outside in communication with the suction hole 8*c*. A lower portion of the external air introduction hole 11*d* is formed to partially cut a portion in the circumferential direction of the circumferential edge section inward in the radial direction of the ceiling wall section 11*a*.

In addition, a barrier 11*f* stands on an opening circumferential edge section of the external air introduction hole 11*d* in the upper surface of the ceiling wall section 11*a*. The barrier 11*f* is formed to cover a lower end section of the opening circumferential edge section of the external air introduction hole 11*d* opened at the connecting tube 17 from the outside in the radial direction. Further, the barrier 11*f* is formed to be gradually thinner toward the upper side.

In addition, an annular engaging protrusion 19*a* extending in the circumferential direction while protruding outward in the radial direction is formed at the upper end section of the discharge tube suppressing member 19. Further, in the discharge tube suppressing member 19, an annular engaging concave section 19*b* extending in the circumferential direction while being concaved outward in the radial direction is formed at a lower inner circumferential surface extending downward from a central section connected to the flange 18.

The valve tube body 12 includes a communication tube 12*a* and a valve member 12*b*. The communication tube 12*a* is fitted onto the topped tubular body 100. The valve member 12*b* is disposed in the upper end section of the communication tube 12*a*, and configured to switch communication between the discharge port 5 and the communication hole 10*g* and blocking the communication. The communication tube 12*a* is formed in a two-step tube shape along an exterior of the topped tubular body 100. An upper surface of the ceiling wall section 10*a* of the inner tube body 10 abuts a lower end opening edge of the communication tube 12*a*.

The valve member 12*b* includes the valve body 12*d* and an elastic connecting piece 12*e*. The valve body 12*d* is configured to freely open/close the communication hole 10*g* of the inner tube body 10 from the upper side. The elastic connecting piece 12*e* is configured to connect the valve body 12*d* and the communication tube 12*a*, and to be elastically deformed by variation in the pressure inside the inner container 2 or the weight of the contents to operate the valve body 12*d* to open/close the communication hole 10*g*.

The valve body 12*d* has a circular plate shape. The outer edge section of the valve body 12*d* abuts the valve seat 10*h* of the top section 100*a* of the topped tubular body 100 of the inner tube body 10. In addition, the elastic connecting piece 12*e* has an arc shape in a plan view when the valve member 12*b* is seen from an upper side thereof, and connects the outer edge section of the valve body 12*d* and the upper end section of the inner circumferential surface of the communication tube 12*a*. The plurality of elastic connecting pieces 12*e* are formed between the communication tube 12*a* and the valve body 12*d* in the circumferential direction at intervals. As the elastic connecting piece 12*e* is elastically deformed, the valve body 12*d* is configured to open the communication hole 10*g* while being displaced upward with respect to the top section 100*a*. When the valve body 12*d* is separated from the valve seat 10*h* the contents flow through the gap between the neighboring elastic connecting pieces 12*e* in the circumferential direction.

Next, the discharge tube body 15 includes a ceiling wall section 15*a*, and a circumferential wall section 15*b* extending downward from an outer circumferential edge section of the ceiling wall section 15*a* and disposed outside in the radial direction of the communication tube 12*a* of the valve tube body 12. The ceiling wall section 15*a* is disposed over the port section 4*a* of the container main body 4, and the discharge port 5 is formed at a central region in the radial direction of the ceiling wall section 15*a*. A discharge film 20 that can be elastically deformed to close the discharge port 5 is formed at the ceiling wall section 15*a*. In the shown example, the discharge film 20 protrudes inward in the radial direction from the inner circumferential surface of the discharge port 5.

The circumferential wall section 15*b* is formed in a two-step tubular shape including an upper tube section 151 formed along an exterior of the communication tube 12*a* of the valve tube body 12 and disposed at the upper side, and a lower tube section 152 disposed at the lower side and having a larger diameter than the upper tube section 151. The lower end section of the lower tube section 152 abuts the upper surface of the ceiling wall section 10*a* of the inner tube body 10. Here, the topped tubular body 100 is disposed to be inserted into the circumferential wall section 15*b*. Further, the tube section of the bottom tubular body 100, the communication tube 12*a* of the valve tube body 12 and the circumferential wall section 15*b* of the discharge tube body 15 are formed to overlap in the radial direction.

An annular stepped section 153 is formed between the upper tube section 151 and the lower tube section 152, and a lower surface of the stepped section 153 abuts a stepped section formed at the valve tube body 12. Further, an upper surface of the stepped section 153 abuts the discharge tube suppressing member 19, and the discharge tube body 15 is pressed by the outer tube body 11 from the upper side. Furthermore, an annular engaging protrusion 152*a* extending in the circumferential direction while protruding outward in the radial direction is formed at the upper outer circumferential surface of the lower tube section 152. The engaging protrusion 152*a* is engaged with an engaging concave section 19*b* formed at the discharge tube suppressing member 19.

Figure 2:
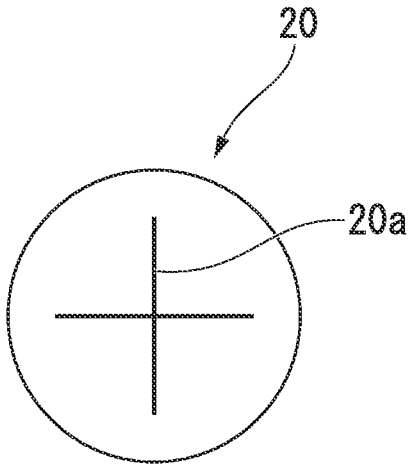
FIG. 2 is a view for describing a shape of a slit of a discharge film in the discharge container of FIG. 1.

Then, the discharge film 20 is formed in a curved surface shape protruding toward the upper side. In a plan view of the discharge film 20 shown in FIG. 2, a slit 20*a* is formed in the central section of the discharge film 20. In an example shown in FIG. 2, the slit 20*a* is formed in an X shape (a cross shape). Then, as the discharge film 20 is elastically deformed according to an increase in the pressure inside the inner container 2, the slit 20*a* is widely opened and the discharge port 5 is opened.

In addition, an air valve 15*c* is installed at a lower outer circumferential surface of the lower tube section 152 of the circumferential wall section 15*b*. In the embodiment, the discharge film 20 and the air valve 15*c* are integrally formed with each other. The air valve 15*c* has an annular shape extending in the circumferential direction while protruding outward in the radial direction from the central section in the container axis O direction of the lower tube section 152, and is configured to be elastically deformed. In the longitudinal cross-sectional view of the discharge container 1 shown in FIG. 1, the air valve 15*c* extends gradually upward in the radial direction as it goes outward. In addition, an annular protrusion 15*f* extending in the circumferential direction while protruding upward is formed at the outer edge section of the air valve 15*c*. The annular protrusion 15*f* is configured to be spaced apart downward from the air valve seat 11*e* by elastic deformation of the air valve 15*c* while abutting an air valve seat 11*e* from a lower side of the air valve seat 11*e*.

Next, the over cap 7 is formed in a tubular shape having a top section including a ceiling wall section 7*a* and a circumferential wall section 7*b*. An abutting section 7*c* abutting the discharge film 20 is formed at a center in the radial direction of the ceiling wall section 7*a*. The abutting section 7*c* is formed to expand downward. The abutting section 7*c* has a dome shape or a hemispherical shape protruding downward from the ceiling wall section 7*a*.

In addition, an inner tube section 7*d* and an outer tube section 7*e* are formed at the ceiling wall section 7*a*. The inner tube section 7*d* is disposed outside in the radial direction of the abutting section 7*c* and formed to protrude downward. The outer tube section 7*e* is disposed outside in the radial direction of the inner tube section 7*d* and formed to protrude downward. The inner tube section 7*d* is fitted into the upper end section of the discharge tube suppressing member 19. In addition, the outer tube section 7*e* is fitted onto the upper end section of the discharge tube suppressing member 19. An annular engaging protrusion 7*f* extending in the circumferential direction while protruding inward in the radial direction is formed at the lower end section of the outer tube section 7*e*. The engaging protrusion 7*f* is configured to abut an engaging protrusion 19*a* of the discharge tube suppressing member 19 and fitted thereinto at an undercut portion thereof.

In addition, a hinge 14 is installed between the lower end section of the circumferential wall section 7*b* of the over cap 7 and the upper end section of the circumferential wall section 11*b* of the outer tube body 11 to connect them. The hinge 14 is disposed at a position in the circumferential direction at which the external air introduction hole 11*d* is disposed, i.e., a position outside in the radial direction of the external air introduction hole 11*d*. In the upper end section of the circumferential wall section 7*b* of the over cap 7, an opening/closing manipulation piece 7*g* protruding outward in the radial direction is formed at an opposite side of the hinge 14 with the container axis O sandwiched therebetween in the radial direction.

Figure 3:
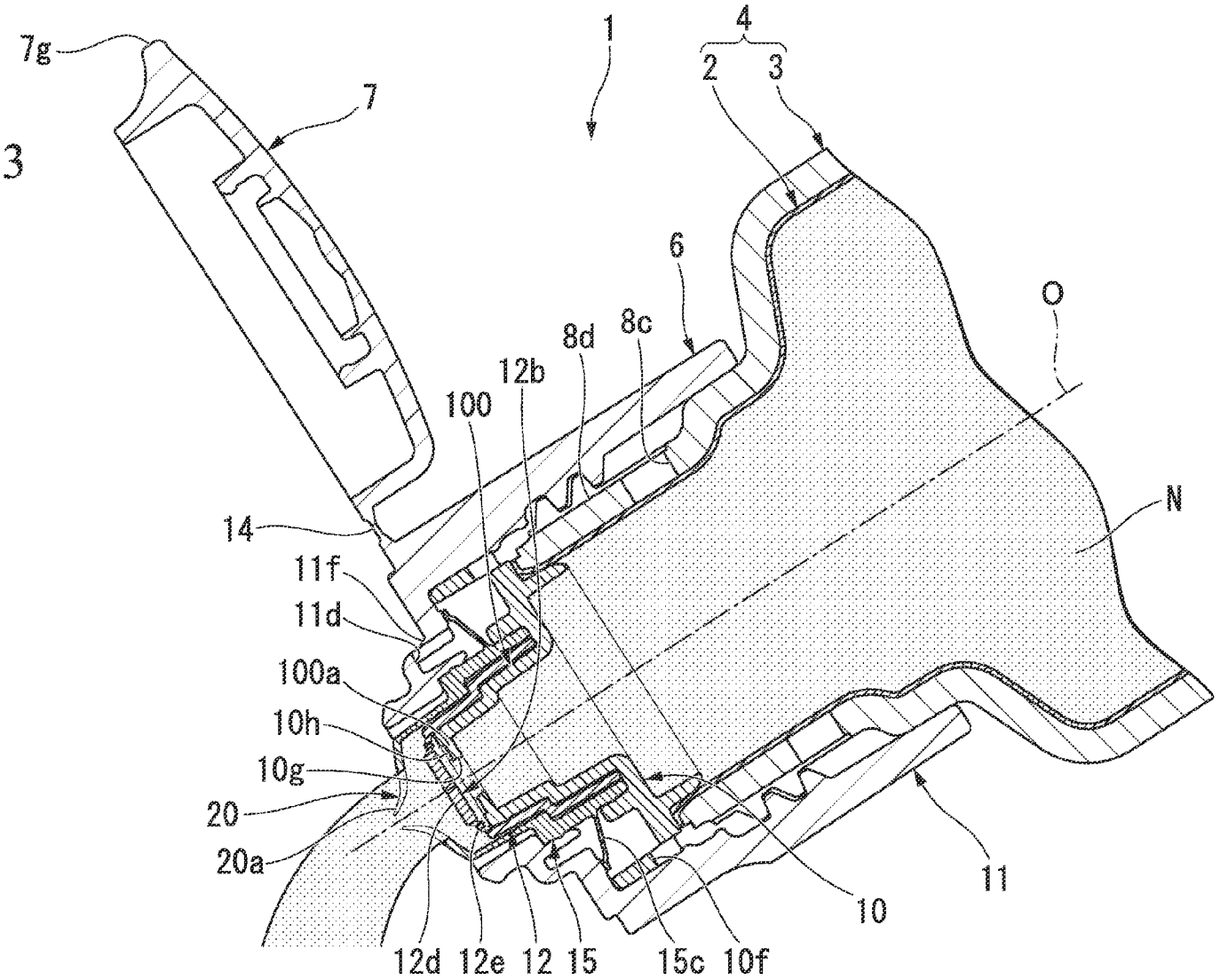
FIG. 3 is a view for describing a state in which contents are discharged from a discharge port of the discharge container of FIG. 1.

In the discharge container 1 of the above-mentioned embodiment, when the contents accommodated in the inner container 2 of the container main body 4 is discharged, the opening/closing manipulation piece 7*g* is manipulated to open the over cap 7. Then, as shown in FIG. 3, in a state in which the discharge container 1 is in a discharge posture such that the discharge film 20 is inclined downward, the outer container 3 of the container main body 4 is squeezed and deformed (elastically deformed). Accordingly, the inner container 2 is deformed and reduced in volume with the outer container 3.

Then, the pressure inside the inner container 2 increases due to the volume-reducing deformation. As the elastic connecting piece 12*e* is elastically deformed by the positive pressure, the valve body 12*d* is spaced apart from the valve seat 10*h* to open the valve member 12*b*, and the discharge port 5 comes in communication with the inside of the inner container 2 through the communication hole 10*g*. Here, when the container main body 4 is inclined, the weight of the contents thereof is also applied to the valve member 12*b*.

As the valve member 12*b* is opened as described above, the pressure (the positive pressure) of the inner container 2 and the weight of the contents are applied to the discharge film 20, and as the discharge film 20 is elastically deformed, the slit 20*a* is widely opened and the discharge port 5 is opened. Accordingly, the contents accommodated in the inner container 2 are discharged from the discharge port 5.

After that, when the pressure inside the inner container 2 is decreased, the elastic connecting piece 12*e* is deformed so as to be recoverable by an elastic recovering force and the valve body 12*d* sits on the valve seat 10*h* to close the valve member 12*b*. Accordingly, communication between the discharge port 5 and the inside of the inner container 2 through the communication hole 10*g* is blocked, the discharge film 20 is deformed so as to be recoverable by the elastic recovering force, the slit 20*a* is closed, and the discharge port 5 is closed. As the valve member 12*b* is closed as described above, the inner container 2 is sealed, and further, when the above-mentioned squeezing deformation is released, a recovering deformation force is applied to the outer container 3. Here, the negative pressure generated between the outer container 3 and the inner container 2 is applied to the air valve 15*c* through the suction hole 8*c*. Accordingly, the air valve 15*c* is opened toward the suction hole 8*c*, the suction hole 8*c* and the outside are in communication with each other through the external air introduction hole 11*d*, and the external air is suctioned from the suction hole 8*c* to between the outer container 3 and the inner container 2 through the external air introduction hole 11*d*, the external air circulation hole 10*f*, and the groove 8*d*.

Then, as the external air is suctioned, when the pressure between the outer container 3 and the inner container 2 is increased to atmospheric pressure, the air valve 15*c* is deformed so as to be recoverable to block the suction hole 8*c* and the external air introduction hole 11*d*. In this way, as the external air is suctioned between the outer container 3 and the inner container 2, a volume-reducing shape of the inner container 2 is held.

Figure 4:
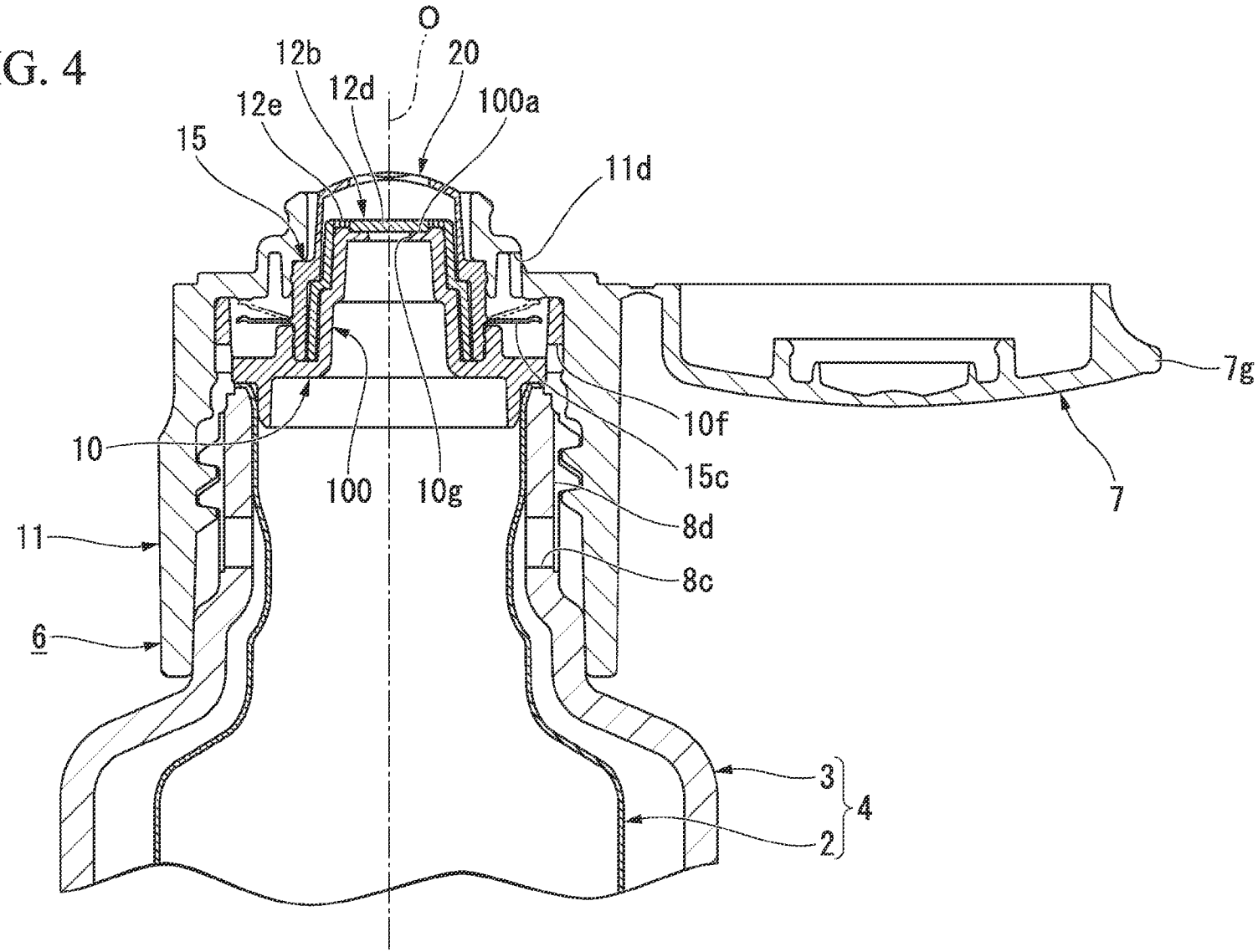
FIG. 4 is a view for describing a state after discharge of the contents in the discharge container of FIG. 1.

FIG. 4 shows a state in which the external air is suctioned between the outer container 3 and the inner container 2.

From this state, when the outer container 3 of the container main body 4 is squeezed and deformed again, since the air valve 15*c* is in the blocked state, the pressure between the outer container 3 and the inner container 2 becomes the positive pressure, and the inner container 2 is deformed to reduce the volume by the positive pressure. As the inner container 2 is deformed to reduce the volume, the same effect as described above is obtained and the contents are discharged.

After the discharge, the opening/closing manipulation piece 7*g* is manipulated to be mounted on the discharge cap 6 while closing the over cap 7.

According to the discharge container 1 of the above-mentioned embodiment, since the valve member 12*b* is closed to hold the inner container 2 in the sealed state except when the contents are discharged, the quality of the contents is secured. Further, since the discharge port 5 is not opened until the discharge film 20 is elastically deformed to widely open the slit 20*a*, sealability of the container is increased. Accordingly, after the discharge, even when the contents remain between the discharge port 5 and the valve member 12*b*, unintentional leakage of the contents from the discharge port 5 is prevented.

In addition, as the discharge film 20 is deformed so as to be recoverable to close the slit 20*a*, a liquid exhaustion property of the discharge port 5 can be improved and leftover liquid of the contents is also prevented.

Further, since a simple configuration in which the discharge port 5 is opened/closed by elastic deformation and recovering deformation of the discharge film 20 is provided, the above-mentioned remarkable effect can be exhibited while reducing the number of parts.

Furthermore, in the embodiment, the inside of the communication hole 10*g* is in communication with the inside of the inner container 2, and the communication hole 10*g* is formed in the top section 100*a* of the topped tubular body 100 protruding from the port section 4*a* of the container main body 4 toward the outside of the container main body 4 in the container axis O direction. Accordingly, the distance between the communication hole 10*g* and the discharge port 5 is reduced (approach), and a space generated between them is also reduced. Then, when the space between the communication hole 10*g* and the discharge port 5 is thus reduced, the amount of contents remaining in the space is suppressed. For this reason, unintentional leakage of the contents from the discharge port is more securely prevented. In addition, in the above-mentioned description, the topped tubular body 100 protrudes from the port section 4*a* of the container main body 4 toward the outside of the container main body 4 in the container axis O direction. Specifically, in the embodiment, the topped tubular body 100 stands from the ceiling wall section 10*a* of the inner tube body 10, which is a region disposed inside in the radial direction of the upper end edge of the port section 4*a*.

In addition, in the embodiment, the discharge film 20 is formed in a curved surface shape protruding toward the outside of the container main body 4 in the container axis O direction, and the slit 20*a* is formed in the central section of the discharge film 20. In this case, since the slit 20*a* is widely opened even when the discharge film 20 is not largely deformed by the pressure inside the inner container 2, discharge of the contents is smoothly performed.

[Second Embodiment]

Hereinafter, a second embodiment of the present invention will be described with reference to the accompanying drawings.

Figure 5:
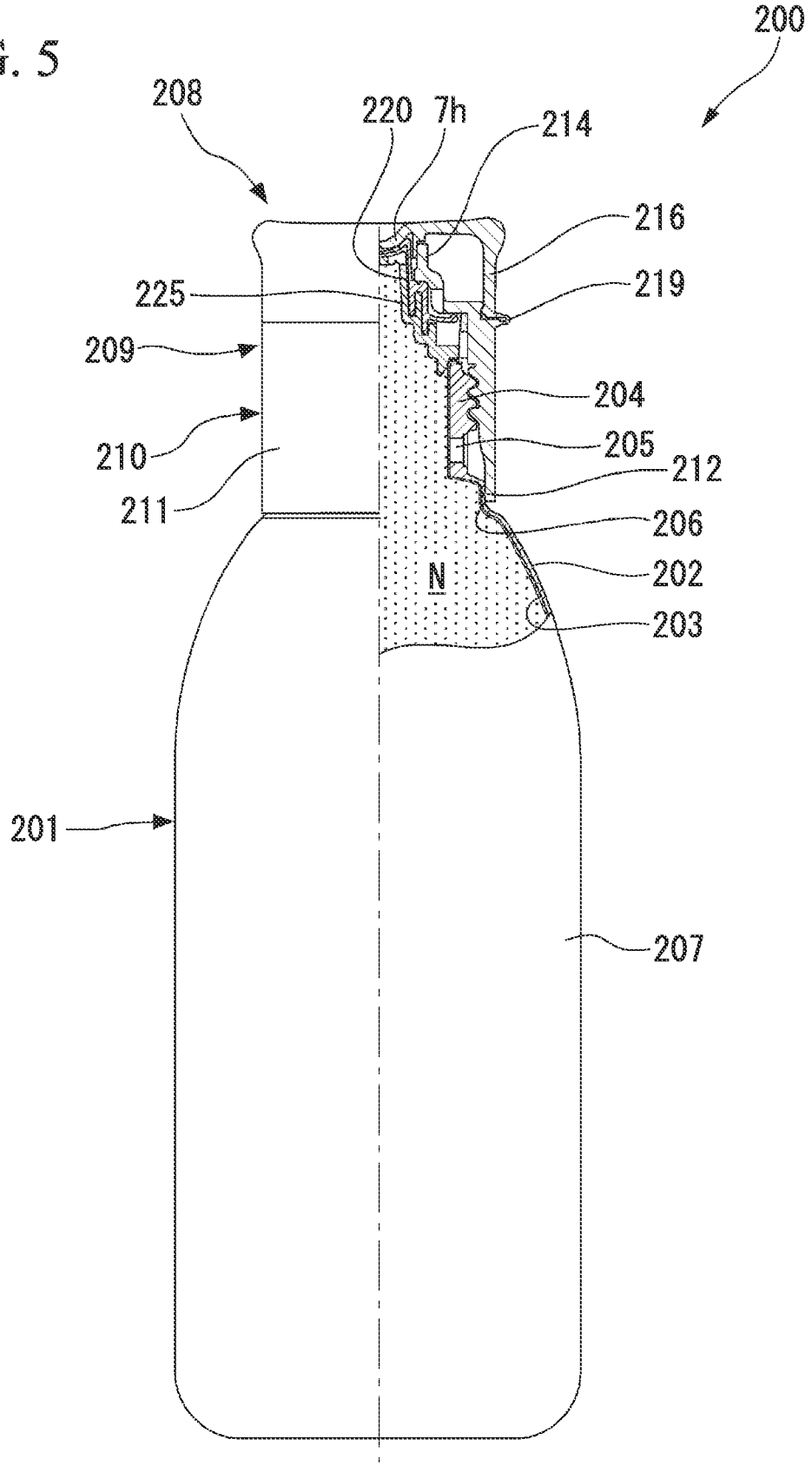
FIG. 5 is a general partial cutaway view showing a discharge container according to a second embodiment of the present invention.
Figure 6:
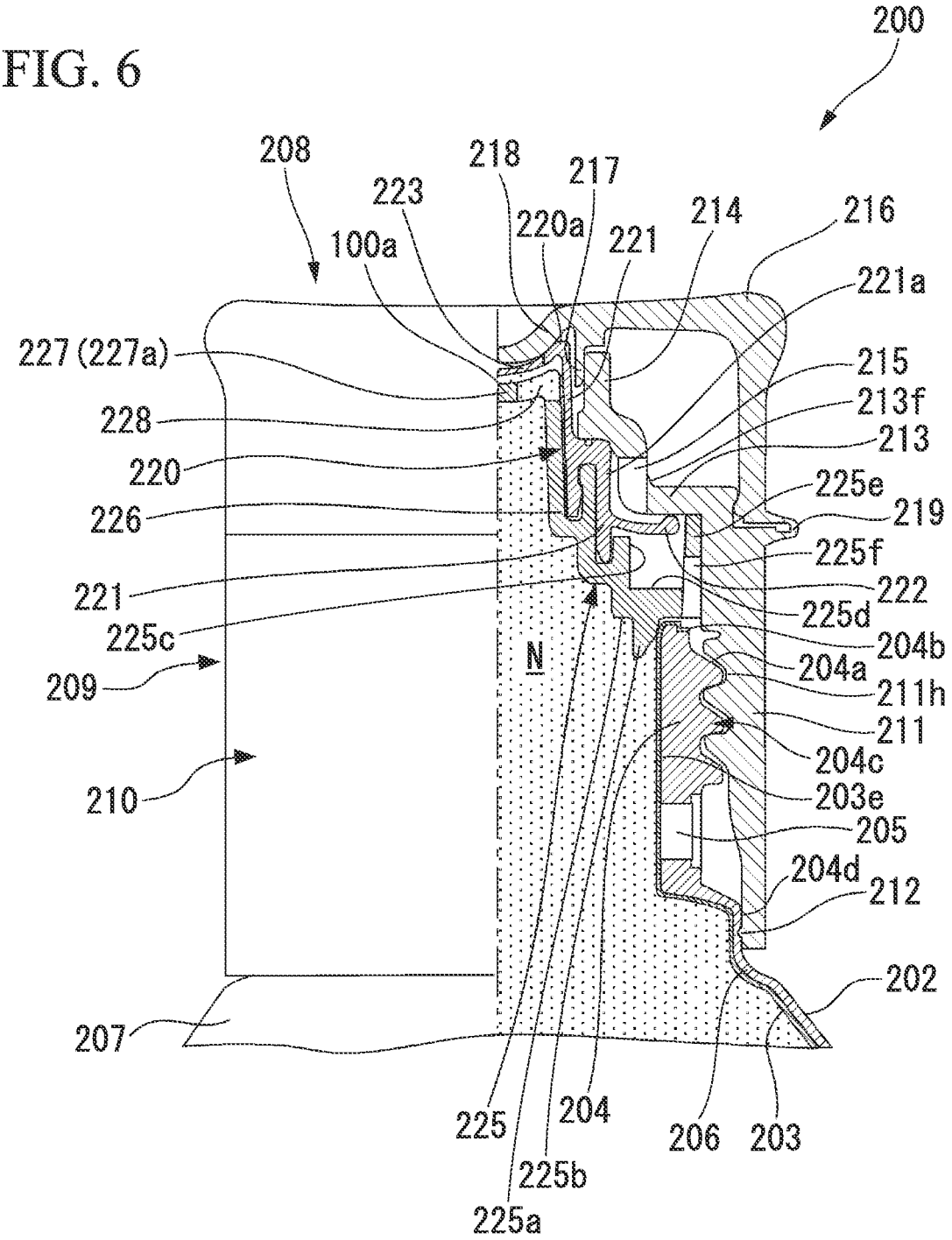
FIG. 6 is an enlarged partial cutaway view showing a state in which a discharge valve of FIG. 5 is closed.

FIG. 5 is a general partial cutaway view showing a state in which a lid section (an over cap) 216 of a discharge container 200 according to the embodiment is closed. As shown in FIG. 6, a container body (a container main body) 201 has an outer layer (an outer container) 202 and an inner layer (an inner container) 203. The container body 201 is blow-formed and configured as a delamination bottle-type container. The outer layer 202 is formed of a low density polyethylene material and has flexibility by which it can be squeezed and deformed so as to be easily recoverable. The inner layer 203 is formed of nylon and separably stacked on the outer layer 202. In addition, the inner layer 203 is formed in a pocket shape configured to accommodate the viscous contents N and to be freely deformed to reduce the volume as the pressure inside the container body 201 decreases.

A trunk section 207 has a bottomed cylindrical shape having a stepped shoulder section 206 formed at an upper end thereof. In the trunk section 207, a cylindrical tube port section (a port section) 204 is formed to stand via a shoulder section having a reduced diameter and formed upward in an arc shape. In the outer layer 202 constituting the tube port section 204, a screw (a male screw section) 204*a* is engraved at an outer circumferential surface of an outer upper tube section 204*c* of an upper side by about a half thereof. In addition, a suction hole 205 configured to suction the external air to a space between the outer layer 202 and the inner layer 203 is opened at an outer lower tube section 204*d* of a lower side of about a half thereof of the outer layer 202 constituting the tube port section 204. The outer circumferential surface of the stepped shoulder section 206 has a smooth surface disposed further outside than a projecting end of the screw. An inner upper tube section 203*e* constituted by the inner layer 203 is stacked on the inner circumferential surface of the outer upper tube section 204*c*. The upper end section of the inner upper tube section 203*e* is disposed on an opening edge 204*b* of the upper end of the outer upper tube section 204*c* bent outward in the radial direction.

As shown in FIG. 6, a cap body 208 assembled to the tube port section 204 of the container body 201 is constituted by a cap main body (a discharge cap) 209 and the lid section 216. The cap main body 209 is constituted by assembling a major body section (an outer tube body) 210, a valve body (a discharge tube body) 220 formed of a soft elastic material, and an inner support plug (an inner tube body) 225. The major body section 210 is assembled to the tube port section 204 of the container body 201. The lid section 216 is integrally coupled to the major body section 210 by a hinge 219.

The major body section 210 has an assembly tube (a circumferential wall section) 211 covered on and threadedly engaged with the tube port section 204 and assembled thereto and a top wall (a ceiling wall section of an outer tube body) 213, and has a circular tube shape having a top section. A female screw section 211*h* threadedly engaged with a male screw section 204*a* of the tube port section 204 is formed at an upper side of an inner circumferential surface of an assembly tube 211. In addition, a seal section 212 configured to come in hermetical contact with a smooth outer circumferential surface (a lower tube section) 204*d* of an upper portion of the stepped shoulder section 206 and prevent leakage of the suctioned external air is formed at an inner circumferential surface lower end section of the assembly tube 211. Further, a tube piece (a discharge tube suppressing member) 214 configured to open a suction port (an external air introduction hole) 215 at a base end section thereof is installed to stand on a center of the top wall 213. A barrier 213*f* stands on an opening circumferential edge section of the suction port 215 in the upper surface of the top wall 213 of the major body section 210. The barrier 213*f* is formed to cover the lower end section in the opening circumferential edge section of the suction port 215 from the outside in the radial direction. In addition, the barrier 213*f* is formed to be thinner toward the upper side.

A plug tube piece (an inner tube section) 217 configured to be hermetically fitted into a tube piece 214 of the major body section 210 is vertically installed under the lid section 216 coupled to the major body section 210 by the hinge 219 at a center of the lower surface of the top plate. Further, the lid section 216 has a pressing top plate 218 in which a top plate portion of the inside of the plug tube piece 217 is recessed in a spherical arc shape.

Basically, the valve body 220 has a cylindrical structure having a top section. The valve body 220 includes a ceiling wall section 220*a*, and a cylindrical assembly main body (a circumferential wall section) 221 extending downward from an outer circumferential edge section of the ceiling wall section 220*a*. The ceiling wall section 220*a* is disposed over the tube port section 204 of the container body 201, and has a shape recessed in a spherical arc shape along an inner surface shape of the pressing top plate 218 of the lid section 216. In the valve body 220, a suction valve (an air valve) 222 is formed in an outer brim shape from an outer circumferential surface of a lower tube section 221*a* of the assembly main body 221, and a top wall portion recessed in a spherical arc shape is constituted as a discharge valve (a discharge film) 223. The suction valve 222 is formed in an outer brim shape having a small thickness. While the suction valve 222 allows intrusion of the external air from the suction port 215 as the circumferential end section comes in hermetical contact with a lower surface portion of the top wall 213 farther outside than the suction port 215, a check valve function configured to prevent discharge of the external air from the suction port 215 is exhibited.

Figure 7:
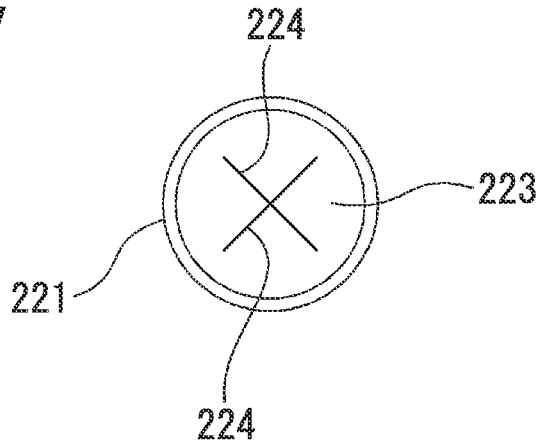
FIG. 7 is an enlarged plan view of a discharge film of FIG. 5.

As shown in FIG. 7, the discharge valve 223 formed at the ceiling wall section 220*a* is constituted by a thin slit valve structure as a cross-shaped slit 224 is formed at the ceiling wall section 220*a*. In addition, a tubular body having an upper end at which the discharge valve 223 is formed is disposed in the tube piece 214 of the major body section 210, and configured to be protected inside in the circumferential direction.

The inner support plug 225 is hermetically fitted and assembled to an opening end of the tube port section 204, and strongly fitted and assembled to an upper end portion of an inner circumferential surface of the assembly tube 211 of the cap main body 209. On the other hand, the valve body 220 is held to be sandwiched between the major body section 210 of the cap main body 209 and the inner support plug 225.

The inner support plug 225 includes a ceiling wall section 225*a* and a circumferential wall section 225*b*, and is formed in a tubular shape having a top section. On the ceiling wall section 225*a* of the inner support plug 225, a locking tube 225*c* having a smaller diameter than the circumferential wall section 225*b* stands, and further, a support tube section (a topped tubular body) 226 having a smaller diameter than the locking tube 225*c* stands. Here, the circumferential wall section 225*b*, the locking tube 225*c* and the support tube section 226 are disposed concentrically with the container axis O.

The inside of the support tube section 226 comes in communication with the inside of the inner layer 203, and the support tube section 226 protrudes upward from the tube port section 204 of the container body 201 and is formed to be longer in the container axis O direction than the locking tube 225*c*. A gap in the radial direction is formed between the support tube section 226 and the locking tube 225*c*.

The lower end section of the lower tube section 221*a* of the assembly main body 221 abuts the upper surface of the ceiling wall section 225*a* of the inner support plug 225. Here, the support tube section 226 is disposed to be inserted into the lower tube section 221*a* of the assembly main body 221. Further, the tube section of the support tube section 226 and the assembly main body 221 of the valve body 220 are installed to overlap in the radial direction.

The circumferential wall section 225*b* of the inner support plug 225 is fitted into the tube port section 204 of the container body 201. An annular brim section 225*d* extending in the circumferential direction while protruding outward in the radial direction is formed at the upper end section of the circumferential wall section 225*b*. The brim section 225*d* is disposed on the opening edge of the upper end of the tube port section 204. Here, a fitting tube section 225*e* protrudes upward from the outer edge section of the brim section 225*d*. In addition, a plurality of external air circulation holes 225*f* passing in the radial direction and opened downward are formed at the lower end section of the fitting tube section 225*e* in the circumferential direction at intervals.

An upper end section of the fitting tube section 225*e* of the inner support plug 225 abuts the lower surface of the top wall 213 of the major body section 210. In addition, the top section 100*a* of the support tube section 226 is disposed over the upper surface of the top wall 213.

Figure 8:
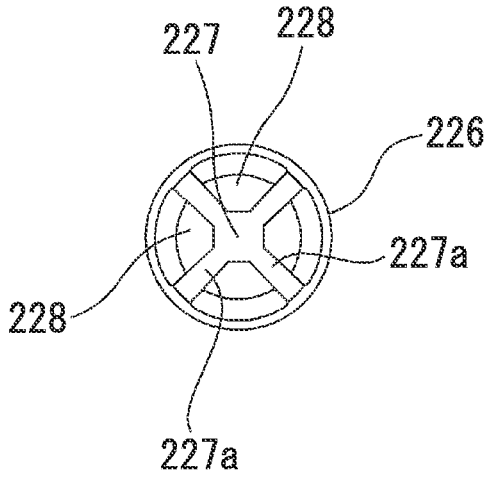
FIG. 8 is an enlarged plan view of a suppressing section of FIG. 5.

Further, as shown in FIG. 8, four through-holes (communication holes) 228 are opened at the top wall portion (the top section 100*a*) disposed near the discharge valve 223 of the cylindrical support tube section 226 having the top section, which stands on a center thereof. As shown in FIG. 8, a baffle plate piece 227*a* having a cross-shaped beam plate piece is formed to remain in the through-hole 228, and the baffle plate piece 227*a* functions as a suppressing section 227. The through-hole 228 near each of the baffle plate pieces 227*a* is disposed at the baffle plate piece 227*a* having the beam plate piece shape. For this reason, upon the discharge operation of the contents N, a large suppressing force does not exert an influence on the contents N flowing through the slit 224 from the through-hole 228.

In addition, a relation of sizes of the baffle plate piece 227*a* and the through-hole 228 is set according to a magnitude of viscosity of the contents N. When the viscosity of the contents N is high, the baffle plate piece 227*a* is thinned, and the opening of the through-hole 228 is increased in size. On the other hand, when the viscosity of the contents N is reduced, the baffle plate piece 227*a* is widened, and the opening of the through-hole 228 is reduced in size. Accordingly, a restriction action of the suppressing section 227 with respect to the contents N is set so as to be adjustable.

Next, an operation example of the shown embodiment will be sequentially described.

In a state in which the lid section 216 shown in FIG. 5 is closed, the pressing top plate 218 of the lid section 216 is disposed to come in contact or near contact with the discharge valve 223, and the discharge valve 223 is configured to prevent the opening operation. For this reason, as the pressing force is applied to the trunk section 207 or the like, even when the pressure inside the container body 201 is increased, the discharge valve 223 is pressed against the pressing top plate 218 not to cause the valve opening operation, and the container is safely held in a state in which unintentional discharge of the contents N does not occur.

Figure 9:
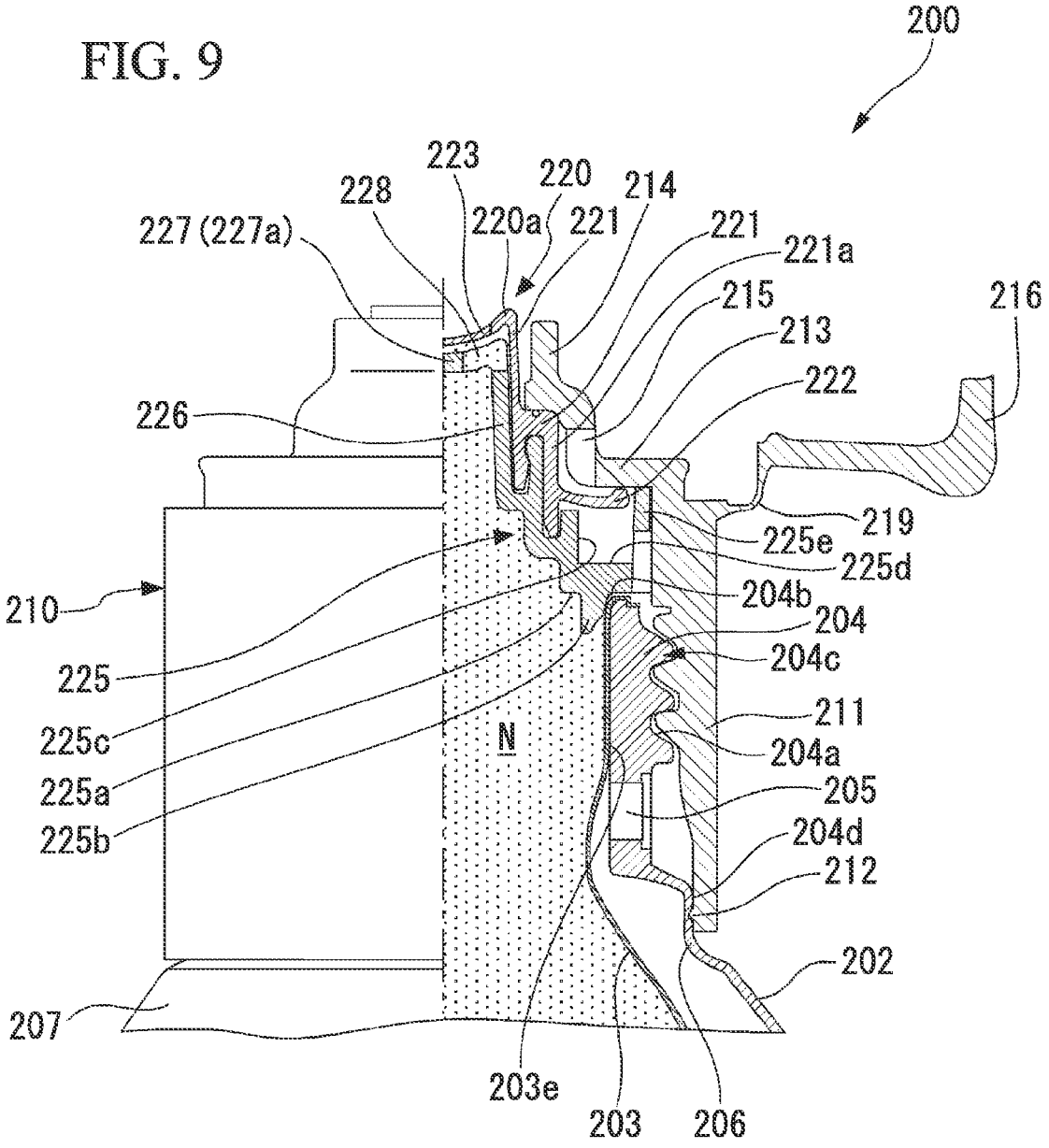
FIG. 9 is an enlarged partial cutaway view showing a state in which a discharge valve of FIG. 5 is open.

In a state in which the lid section 216 shown in FIG. 9 is opened, when the trunk section 207 of the container body 201 is pressed to increase the pressure inside the container body 201, the contents N press and open the discharge valve 223 by the increased pressure and the contents N are discharged from the discharge valve 223. When the desired amount of contents N is discharged to remove the pressing force to the container body 201, the discharge valve 223 is closed to terminate the discharge manipulation. When the discharge manipulation is terminated, a recovering force is generated at the outer layer 202 and pressure reduction in the container body 201 is generated, and the external air is suctioned from the suction port 215. The suction valve 222 is opened by the suctioned external air, and the contents are suctioned from the suction hole 205 to the space between the outer layer 202 and the inner layer 203 through the through-hole formed in the inner support plug 225 and a threaded assembly portion of the tube port section 204 and the assembly tube 211. As a result, the state in which the pressure inside the container body 201 is reduced rapidly disappears.

Here, the pressure reduction of the raised container body 201 is also simultaneously applied to the discharge valve 223. Here, the contents N accommodated inside the discharge valve 223 are in a state in which a flow thereof is suppressed by the suppressing section 227 and do not easily move. For this reason, during a rapid pressure reduction operation by the suction valve 222, the contents N are not moved to a position at which the discharge valve 223 can be opened. For this reason, the discharge valve 223 can eventually exhibit a stable and secure check valve function without intrusion of the external air due to the pressure reduction of the container body 201. In addition, even when the contents N are returned into the inner container, since the suppressing section abuts the discharge valve to suppress the opening of the discharge valve, a stable check valve function can be exhibited.

In addition, the present invention is not limited to the above-mentioned embodiment and various modifications may be made without departing from the spirit of the present invention.

For example, the over cap 7 described in the first embodiment is a hinge type cap pivoted about the hinge 14 to be detachably mounted on the discharge cap 6. However, the embodiment is not limited thereto but the over cap 7 may be configured to be mounted separably from the discharge cap 6. In this case, the over cap 7 may be a screw type cap detachably mounted on the discharge cap 6 through threaded engagement or a fitting cap detachably mounted on the discharge cap 6 through insertion manipulation.

In addition, in the first embodiment, while the slit 20*a* of the discharge film 20 is formed in an X shape, the slit is not limited thereto but may be formed in, for example, a Y shape, an I shape, or the like.

Further, in the first embodiment, in the valve member 12*b*, while an example in which the plurality of elastic connecting pieces 12*e* are formed in an arc shape when seen in a plan view, formed between the communication tube 12*a* and the valve body 12*d* in the circumferential direction at intervals, and configured to connect the communication tube 12*a* and the valve body 12*d* has been described, the embodiment is not limited thereto. That is, the valve member 12*b* may be, for example, a one-point valve or the like in which one elastic connecting piece 12*e* connects the communication tube 12*a* and the valve body 12*d*.

In addition, while the container main body 4 according to the first embodiment is a so-called delamination bottle in which the inner container 2 is separably stacked on the inner surface of the outer container 3, the embodiment is not limited thereto. For example, the container main body 4 may be a dual container in which the inner container 2 and the outer container 3 are separately formed.

Further, in the first embodiment, while the discharge cap 6 is configured to be mounted on the port section 4*a* as the male screw section 8*b* of the port section 4*a* of the container main body 4 is threadedly engaged with the female screw section 11*h* of the outer tube body 11, the embodiment is not limited thereto. That is, instead of using the male screw section 8*b* and the female screw section 11*h*, for example, a configuration in which an annular protrusion extending in the circumferential direction while protruding inward in the radial direction from the outer tube body 11 is undercut and fitted to an annular protrusion extending in the circumferential direction while protruding outward in the radial direction from the port section 4*a* may be provided.

In addition, in the second embodiment, a configuration in which the base cup is hermetically assembled to the lower end section of the trunk section 207, and the portion functioning as the suction valve is formed at, for example, the base cup and a pinch off section of the bottom section of the container body 201 may be provided. Further, in the second embodiment, the baffle plate piece 227*a* is not limited to a cross beam piece shape but may be a simple flat plate shape. In addition, in the second embodiment, instead of the configuration in which the cap main body 209 is the hinge cap, the major body section 210 and the lid section 216 may be configured as separate members. Further, in the second embodiment, the discharge valve 223 is not limited to a structure recessed in a spherical arc shape but may be a structure expanded in a flat plate shape or a spherical arc shape. Furthermore, in the second embodiment, the slit 224 is not limited to a cross shape but may have a single line shape or a triple line shape. In addition, while not shown, in the second embodiment, the pair of suction holes 205 may be formed in axial symmetry, and a strip-shaped adhesion band may be formed between the outer layer 202 and the inner layer 203 while avoiding both of the suction holes 205 throughout the entire height of the container body 201.

In addition, components of the above-mentioned embodiment may be appropriately substituted with known components, or the above-mentioned variants may be appropriately combined without departing from the spirit of the present invention.

INDUSTRIAL APPLICABILITY

It is possible to provide a discharge container capable of securing quality of contents and preventing leakage from a discharge port without increasing the number of parts. In addition, in the discharge container, a slit valve having an extremely simple structure and capable of rapidly performing a valve operation can be safely used in a delamination bottle-type discharge container. For this reason, a discharge film portion of the delamination bottle-type discharge container can be reduced in price and simplified in structure. In particular, the discharge container can be widely used in the delamination bottle-type discharge container.

DESCRIPTION OF REFERENCE SIGNS

1 discharge container
2 inner container
3 outer container
4 container main body
4*a* port section
5 discharge port
6 discharge cap
8*c*, 205 suction hole
10*g* communication hole
11*d* external air introduction hole
12*b* valve member
15*c* air valve
20 discharge film
20*a* slit
100 topped tubular body
O container axis
201 container body (container main body)
202 outer layer (outer container)
203 inner layer (inner container)
204 tube port section (port section)
206 stepped shoulder section
207 trunk section
208 cap body
209 cap main body (discharge cap)
210 major body section (outer tube body)
211 assembly tube (circumferential wall section)
212 seal section
213 top wall (ceiling wall section)
214 tube piece (discharge tube suppressing member)
215 suction port (external air introduction hole)
216 lid section (over cap)
217 plug tube piece (inner tube section)
218 pressing top plate
219 hinge
220 valve body (discharge tube body)
221 assembly main body (circumferential wall section)
222 suction valve (air valve)
223 discharge valve (discharge film)
224 slit
225 inner support plug (inner tube body)
226 support tube section (topped tubular body)
227 suppressing section
227*a* baffle plate piece
228 through-hole (communication hole)
N contents

The invention claimed is:

1. A discharge container comprising:

a container main body having an inner container configured to accommodate contents and configured to deform according to reduction of the contents, and an outer container in which the inner container is installed to be elastically deformed; and a discharge cap mounted on a port section of the container main body, the discharge cap having a discharge port configured to discharge the contents and a communication hole configured to bring the discharge port in communication with the inside of the inner container, and a suction hole configured to suction external air to a space between the inner container and the outer container, the suction hole being formed in the outer container, and wherein the discharge cap comprises:

an air valve configured to switch between allowing and blocking communication between the outside of the discharge cap and the suction hole; and a discharge film elastically deformable to close the discharge port, the discharge film being formed at an outermost part of the discharge port, a slit that is formed in the discharge film, the slit being widened and opened to open the discharge port as the discharge film is elastically deformed according to an increase in pressure inside the inner container, a cap main body having an outer tube body configured to cover the discharge cap on the port section of the container main body, an inner support plug hermetically assembled to an opening end of the port section and formed in a tubular shape having a top section, and a valve body hermetically assembled and fixed to be sandwiched between the inner support plug and the cap main body, wherein a top plate portion of the inner support plug disposed near the inside of the discharge film installed at the valve body is configured such that a baffle plate piece having a beam plate piece shape remains to open the communication hole, and the baffle plate piece is configured to apply a suppressing force to a flow of the contents.

2. The discharge container according to claim 1, wherein the discharge cap further comprises:

an external air introduction hole configured to bring the outside in communication with the suction hole; and a valve member configured to switch between allowing and blocking communication between the discharge port and the communication hole, wherein the air valve switches between allowing and blocking communication between the suction hole and the external air introduction hole, and an inside of the communication hole is in communication with the inside of the inner container, and is formed at a top section of a topped tubular body protruding from the port section of the container main body toward the outside of the container main body in a container axial direction.

3. The discharge container according to claim 2, wherein the discharge film is formed in a curved surface shape protruding toward the outside of the container main body in the container axial direction, and the slit is formed in a central section of the discharge film.

4. The discharge container according to claim 1, wherein the slit formed in the discharge film is formed in a cross shape, and the baffle plate piece has a cross beam piece shape disposed opposite to the slit.

* * * * *